US009702097B2

(12) United States Patent
Perut

(10) Patent No.: US 9,702,097 B2
(45) Date of Patent: Jul. 11, 2017

(54) LIMITED VIEW DYNAMIC MESSAGE SIGN FOR TRAFFIC INFORMATION

(71) Applicant: SES America, Inc., Warwick, RI (US)

(72) Inventor: Philippe Perut, Providence, RI (US)

(73) Assignee: SES America, Inc.

( * ) Notice: Subject to any disclaimer, the term of this patent is extended or adjusted under 35 U.S.C. 154(b) by 0 days.

(21) Appl. No.: 15/394,287

(22) Filed: Dec. 29, 2016

(65) Prior Publication Data

US 2017/0107677 A1 Apr. 20, 2017

Related U.S. Application Data

(63) Continuation of application No. 14/970,287, filed on Dec. 15, 2015, now Pat. No. 9,552,752.

(60) Provisional application No. 62/218,937, filed on Sep. 15, 2015.

(51) Int. Cl.

| | |
|---|---|
| ***E01F 9/00*** | (2016.01) |
| ***G08G 1/09*** | (2006.01) |
| ***G09F 11/00*** | (2006.01) |
| ***G09F 13/22*** | (2006.01) |
| ***G09F 9/33*** | (2006.01) |

(52) U.S. Cl.

CPC ..... *E01F 9/00* (2013.01); *G08G 1/09* (2013.01); *G09F 9/33* (2013.01); *G09F 11/00* (2013.01); *G09F 13/22* (2013.01); *G09F 2013/222* (2013.01)

(58) Field of Classification Search

CPC ..... G09F 13/22; G09F 2013/222; G09F 7/18; G09F 2007/1843; G09F 9/30; G09F 2007/1873; G09F 2007/1878

See application file for complete search history.

(56) References Cited

U.S. PATENT DOCUMENTS

| | | | | |
|---|---|---|---|---|
| 4,726,134 A * | 2/1988 | Woltman | G09F 13/16 | 359/532 |
| 5,647,152 A * | 7/1997 | Miura | G09F 9/30 | 348/E5.131 |
| 5,758,442 A * | 6/1998 | Flanigan | G09F 9/37 | 40/492 |
| 6,154,945 A * | 12/2000 | Voelzke | G09F 13/04 | 29/426.1 |
| 8,350,788 B1 * | 1/2013 | Nearman | G09F 9/3026 | 315/169.3 |
| 2005/0081414 A1 * | 4/2005 | Lutz | G09F 7/18 | 40/564 |
| 2007/0165162 A1 * | 7/2007 | Meersman | G09F 9/30 | 349/114 |

(Continued)

*Primary Examiner* — Gary C Hoge

(74) *Attorney, Agent, or Firm* — Adler Pollock & Sheehan P.C.; Daniel J. Holmander

(57) ABSTRACT

A dynamic message sign includes a front housing defining a viewing window and an interior. A LED assembly is in the interior for displaying a message within a cone of vision. A louver assembly limits the cone of vision. The dynamic message sign may also include a back frame for supporting the front housing and a bracket for setting the front assembly at an angle with respect to the back frame. The LED assembly can include a plurality of LED pixels arranged in rows and columns. The louver assembly can include a plurality of louver racks, each louver rack extending adjacent to a column of LED pixels.

5 Claims, 10 Drawing Sheets

(56) References Cited

U.S. PATENT DOCUMENTS

| | | | | |
|---|---|---|---|---|
| 2008/0136658 | A1* | 6/2008 | Brask | G09F 9/30 340/815.4 |
| 2008/0141570 | A1* | 6/2008 | Nearman | G09F 9/30 40/574 |
| 2009/0113772 | A1* | 5/2009 | Traupianski | G09F 19/22 40/446 |
| 2010/0182769 | A1* | 7/2010 | Meersman | G09F 9/33 362/97.1 |
| 2012/0170271 | A1* | 7/2012 | Bertele | G09F 9/33 362/249.02 |
| 2012/0324771 | A1* | 12/2012 | Safavi | G09F 9/33 40/452 |
| 2015/0170899 | A1* | 6/2015 | Hatano | G06F 9/30 29/525.11 |

* cited by examiner

LIMITED VIEW DYNAMIC MESSAGE SIGN FOR TRAFFIC INFORMATION

CROSS-REFERENCE TO RELATED APPLICATION

This application claims the benefit of U.S. Provisional Patent Application No. 62/218,937 filed Sep. 15, 2015 and is a continuation of U.S. patent application Ser. No. 14/970,287 filed Dec. 15, 2015, which are incorporated herein by reference.

BACKGROUND OF THE INVENTION

1. Field of the Invention

The subject disclosure relates to methods and signs for displaying information, and more particularly to methods and signs for displaying information to motorists.

2. Background of the Related Art

Signs next to and above highways have become commonplace. Such signs can provide motorists with important information such as real-time traffic information, emergency conditions, and detour information. Signs can also provide ample advertising, instructional and other information. Dynamic Message Signs (DMS) have become a popular choice to present such information. For example, see U.S. PG Pub. No. 2004/0123501 published on Jul. 1, 2004 to Safavi et al., U.S. PG Pub. No. 2013/0282154 published on Oct. 24, 2013 to Chappall et al., and U.S. Pat. No. 7,511,634 issued on Mar. 31, 2009 to Stehle et al.

The typical DMS is LED based technology. Such DMS have a large cone of vision when used on roads to allow motorists from great distances and any lane to read the DMS. Although LED technology is bright and easy to read, modification is difficult.

SUMMARY OF THE INVENTION

Despite the advances noted above, a need exists for a DMS that has a reduced cone of vision in one or more directions yet still takes advantage of LED technology. Preferably, the reduced cone of vision allows new applications such as displaying a toll rate for High Occupancy lanes.

In one embodiment, the subject technology is directed to a dynamic message sign comprising a front housing defining a viewing window and an interior. A LED assembly is in the interior for displaying a message within a cone of vision. A louver assembly selectively limits the cone of vision. The dynamic message sign may also include a back frame for supporting the front housing. An optional bracket between the back frame and front housing can set the front assembly at an angle with respect to the back frame. The LED assembly can include a plurality of LED pixels arranged in rows and columns. The louver assembly can include a plurality of louver racks, each louver rack extending adjacent to a column of LED pixels.

Another embodiment of the subject technology is directed to a dynamic message sign (DMS) having a plurality of LEDs clustered together. The DMS includes at least one louver for limiting viewing of the plurality of LEDs in a desired direction. At least one louver is preferably adjacent each LED. The LEDs may be grouped in a plurality of pixels and the at least one louver may be adjacent each pixel. Typically, the at least one louver is mounted vertically on a side of each LED pixel if not both sides of each LED pixel.

The subject technology also includes a method for displaying a message on a DMS comprising the steps of: mounting a LED display assembly in a front housing of the DMS, the LED display having a cone of vision; limiting the cone of vision by mounting a plurality of louver racks on the front housing; and aligning the DMS with lanes of a road so that at least one lane is excluded for a length of road from viewing a message on the LED display assembly that would otherwise be seen if not for the louver racks. The method may also include mounting the front housing at an angle with respect to a flow of traffic, mounting the front housing on a back frame, and using a bracket between the front housing and the back frame to set the angle. Preferably, the LED assembly includes a plurality of LED pixels arranged in rows and columns and each louver rack extends adjacent to a column of LED pixels.

It should be appreciated that the subject technology can be implemented and utilized in numerous ways, including without limitation as a process, an apparatus, a system, a device, and a method for applications now known and later developed. These and other unique features of the system disclosed herein will become more readily apparent from the following description and the accompanying drawings.

BRIEF DESCRIPTION OF THE DRAWINGS

So that those having ordinary skill in the art to which the disclosed system appertains will more readily understand how to make and use the same, reference may be had to the following drawings.

DETAILED DESCRIPTION OF PREFERRED EMBODIMENTS

The subject technology overcomes many of the prior art problems associated with Dynamic Message Signs (DMS). The advantages, and other features of the systems and methods disclosed herein, will become more readily apparent to those having ordinary skill in the art from the following detailed description of certain preferred embodiments taken in conjunction with the drawings which set forth representative embodiments of the present invention.

Referring now to FIGS. 1A-E, various views of a Dynamic Message Sign (DMS) 100 in accordance with the subject technology are shown. The DMS 100 has a front housing 102 rotatably mounted to a back frame 104. The front housing 102 defines an interior 106 enclosing an LED assembly 108 (best seen in FIG. 4). The LED assembly 108 is typically a plurality of LEDs 122 (FIG. 4) clustered together in groups or LED pixels, which are arranged in a rectangular grid. The LED pixels may be any shape such as circular as shown in U.S. Patent Application Pub. No. 2004/0123501 published on Jul. 1, 2004 to Safavi et al.

Figure 1A:
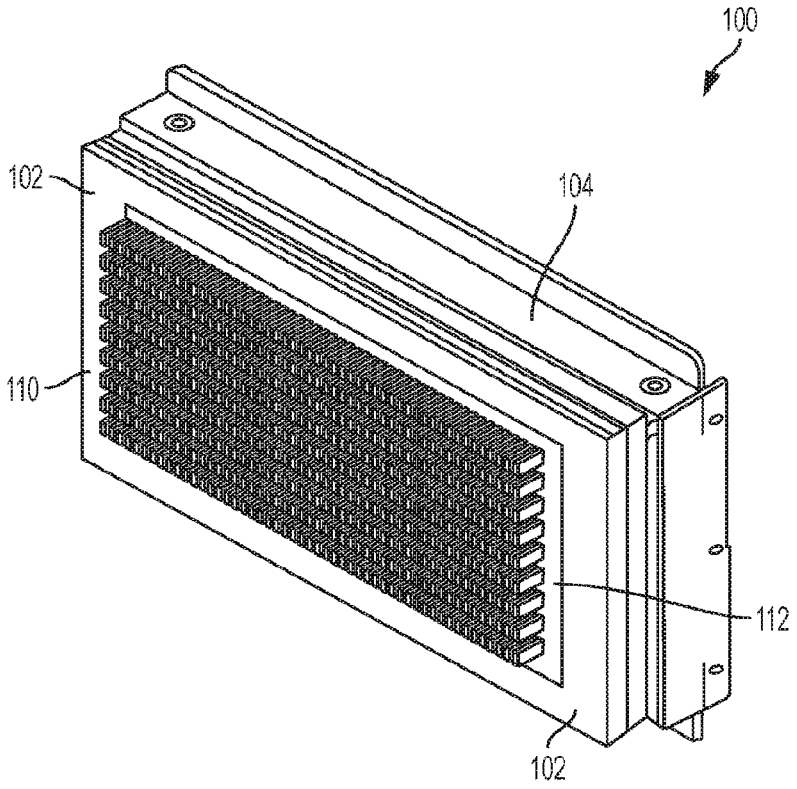
FIG. 1A is a perspective view of a Dynamic Message Sign (DMS) in accordance with the subject technology.
Figure 1B:
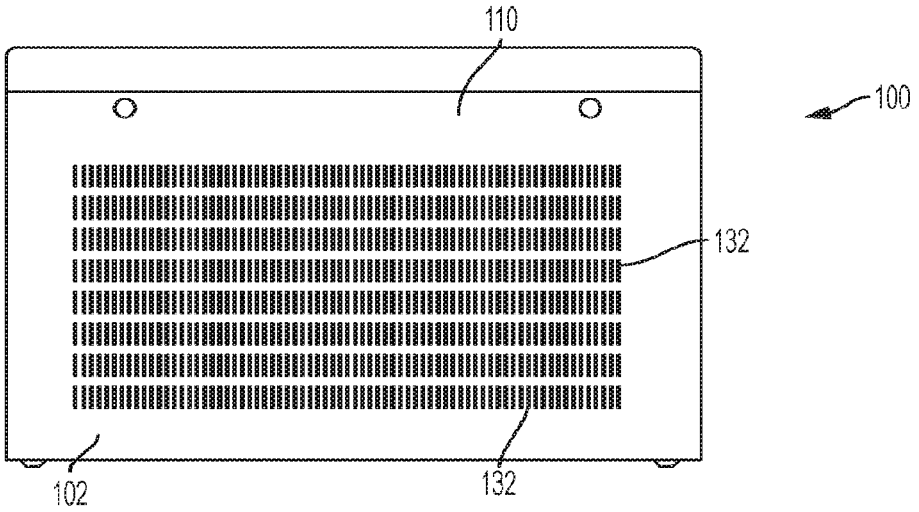
FIG. 1B is a front view of a DMS in accordance with the subject technology.
Figure 1C:
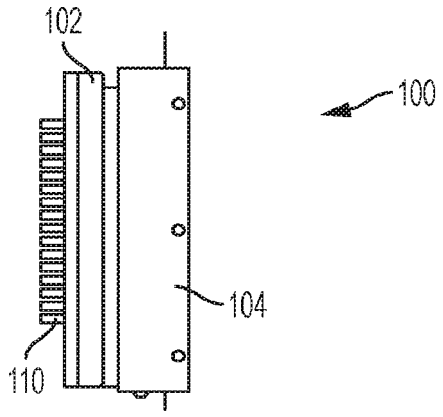
FIG. 1C is a side view of a DMS in accordance with the subject technology.
Figure 1D:
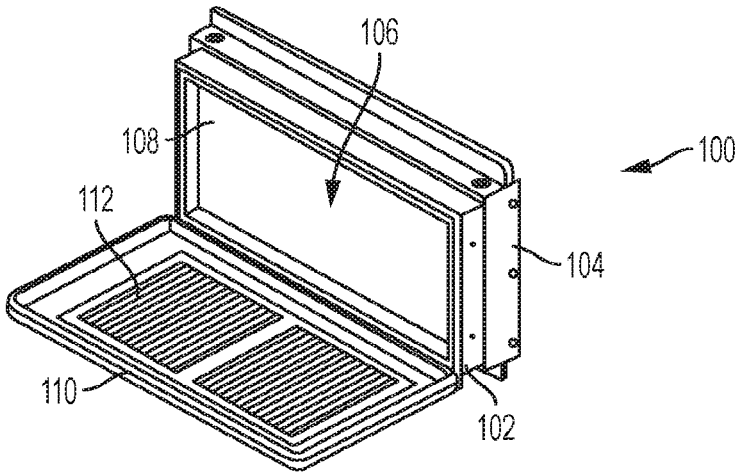
FIG. 1D is a perspective view of a DMS with the front opened in accordance with the subject technology.
Figure 1E:
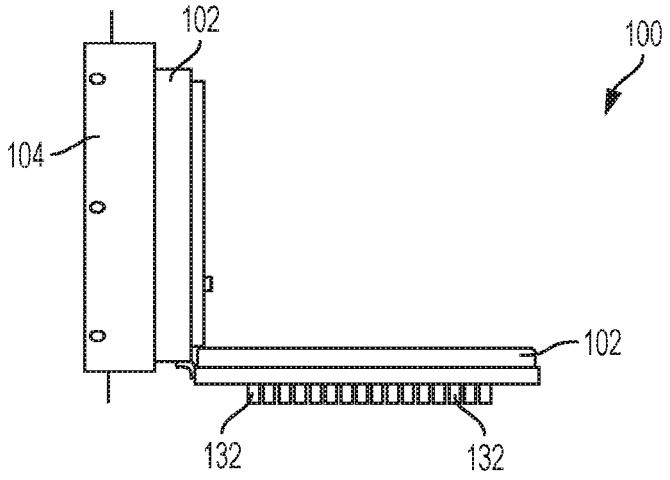
FIG. 1E is a side view of a DMS with the front opened in accordance with the subject technology.

The front housing 102 also includes a louver assembly 110 that is hingedly connected thereto. The louver assembly 110 covers a window 112 that is aligned to allow viewing the LED assembly 108. The louver assembly 110 limits view of the characters displayed in the viewing window 112 in a desired direction as described below with respect to FIGS. 5-9. As shown in FIG. 1D, the front housing 102 can be opened by dropping down the louver assembly 110 to access the LED assembly 108 for maintenance and the like.

Figure 2A:
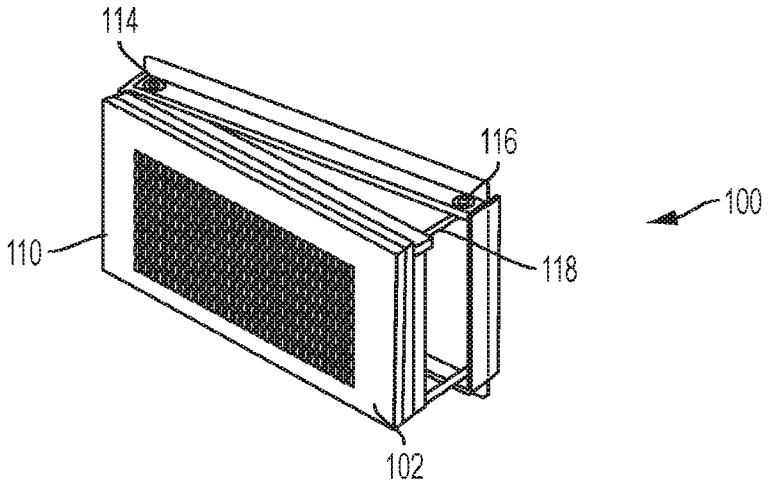
FIG. 2A is a perspective view of a DMS with a front housing/louver assembly set at an angle in accordance with the subject technology.
Figure 2B:
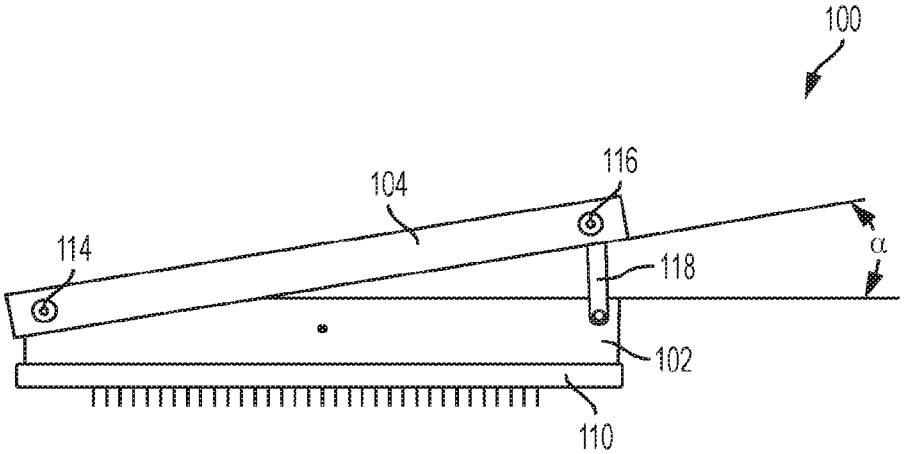
FIG. 2B is a top view of a DMS with a front housing/louver assembly set at an angle in accordance with the subject technology.

Referring now to FIGS. 2A and 2B, the DMS 100 is shown with the front housing 102 set at an angle with respect to the back frame 104. The front housing 102 is hinged at one end 114 and selectively fixed at an opposing end 116 by using a bracket 118. By providing a plurality of differently sized brackets 118 the angle $\alpha$ of the front housing 102 with respect to the back frame 104 can be modified for a particular application. Preferably, the front housing 102 can also have a bracket 118 on the first end 114 and by virtue of a hinge or other mechanism pivot about the second opposing end 116. Typically, the front housing 102 and louver assembly 110 are arranged to fine tune the cone of vision of the DMS 100 for oncoming traffic. Instead of a bracket, a motor can connect between the back frame 104 and front housing 102 for selectively setting the front assembly 102 at an angle with respect to the back frame 104. For example, the motor could be a control module sending signals to a rotary motor connected to a rack and pinion. In another embodiment, a hand crank may be used to set the angle $\alpha$ of the front housing. In still another embodiment, the front housing mounts on a bracket with a series of adjustment points that allow for selection of the angle $\alpha$ of the front housing.

Figure 3A:
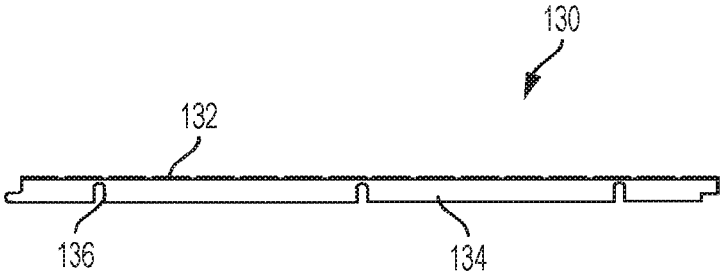
FIG. 3A is a front view of a louver rack for a DMS in accordance with the subject technology.
Figure 3B:
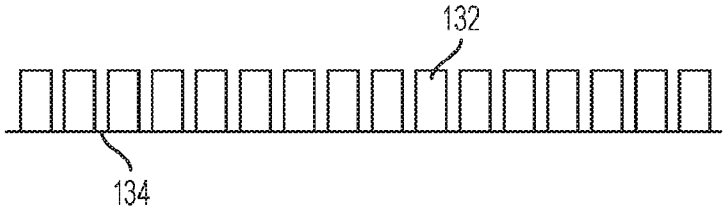
FIG. 3B is a side view of a louver rack for a DMS in accordance with the subject technology.
Figure 3C:
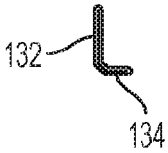
FIG. 3C is a top view of a louver rack for a DMS in accordance with the subject technology.

Referring now to FIGS. 3A-C, several views of a vertical louver rack 130 for the louver assembly 110 are shown. The louver assembly 110 includes as many louver racks 130 as needed to pair up with the LED pixels. Preferably, the louver racks 130 are made of the same material as the front housing 102 and back frame 104 such as aluminum that has a black coating.

The louver rack 130 includes a plurality of rectangular blades or louvers 132 for partially blocking light from the LED pixels. The louvers 132 may be sized and configured to pair with a single LED 122 depending upon the particular application. In another embodiment, the louver rack 130 has a single, long solid louver. The louvers 132 extend from a backing 134 at a right angle. The backing 134 defines slots 136 for easily mounting each louver rack 130 on the front housing 102 in front of the viewing window 112. The louver racks 130 may also be bolted to the front housing 102.

Figure 4:
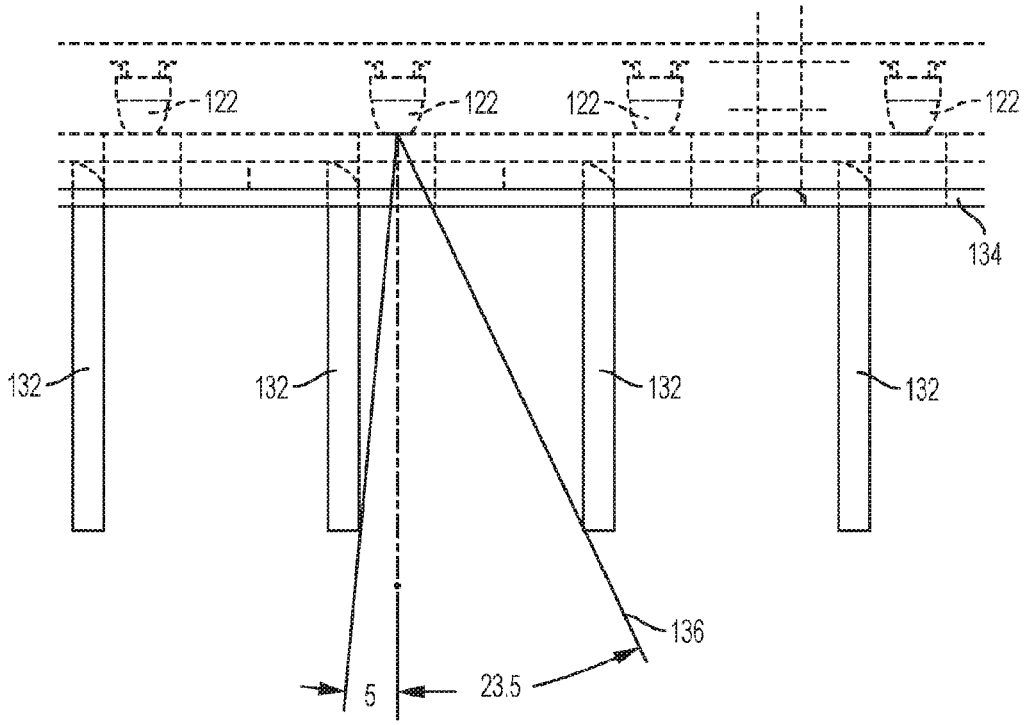
FIG. 4 is a top detailed view of several louvers aligned with LEDs for a DMS in accordance with the subject technology.
Figure 5:
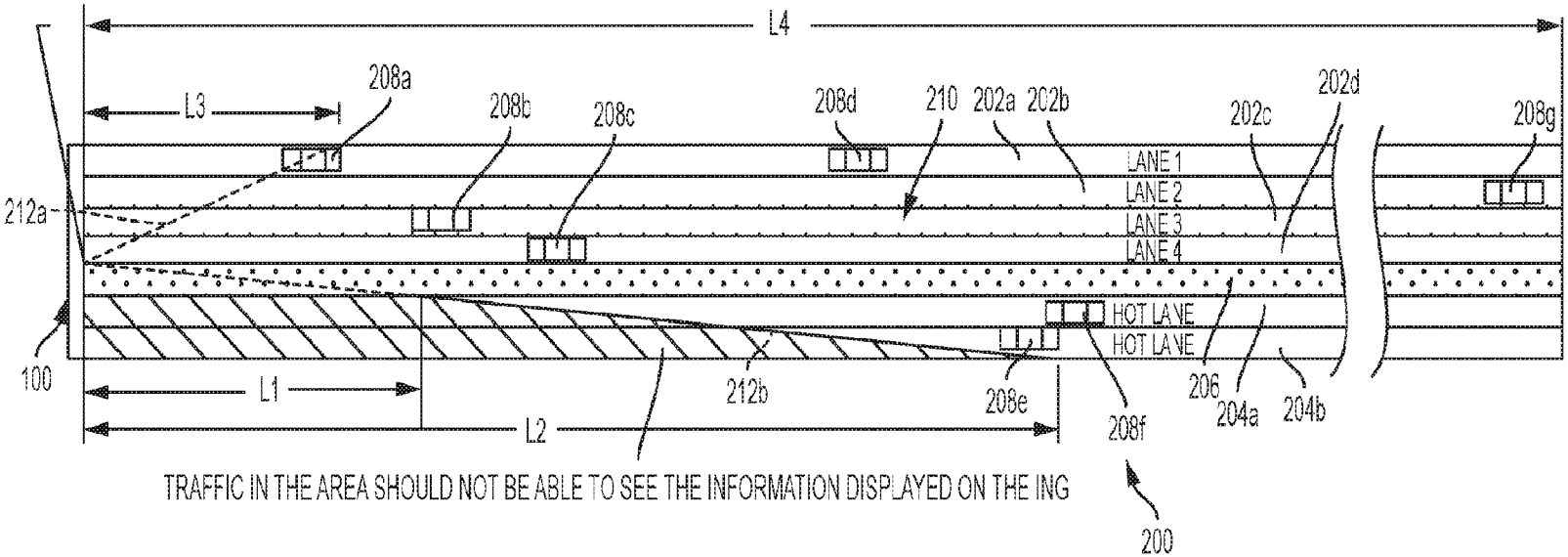
FIG. 5 is an overhead view of a highway with a DMS deployed thereon in accordance with the subject technology.

Referring now to FIG. 4, a top detailed view of several louvers 132 aligned with LEDs 122 for a DMS 100 is shown. In the shown embodiment, the LEDs 122 have a cone of vision 136 of approximately 28.5 degrees. By mounting a louver 132 in front of each LED 122, the effective cone of vision is reduced about 5 degrees. Selection of the size and placement of the louvers 132 can advantageously modify the viewing range of the DMS 100 such as shown in FIG. 5. It is envisioned that the standard cone of vision could be much more than 28.5 degrees and, in any case, the cone of vision can be reduced by the louver assembly to less than 5 degrees. A typical DMS 100 will have a normal cone of vision at about 30 degrees reduced by about 10 to 90 percent depending upon the application. It is envisioned that a louver can be placed on each side of each LED 122 to limit the view in both directions. As a result, an even smaller cone of vision can be created. Any method now known or later developed for mounting or integrating the louvers can be utilized.

FIG. 5 is an overhead view of an exemplary highway 200 with the DMS 100 deployed thereon. The highway 200 has four normal lanes 202*a-d* and two high occupancy (HOT) lanes 204*a-b* separated by a dividing area 206. The DMS 100 would typically be mounted above the road surface in a known manner. A plurality of cars 208*a-g* are shown travelling along the highway 200.

By including the louver assembly as shown in FIG. 4, the viewing area 210 of the DMS message becomes limited as illustrated by demarcation lines 212*a-b*. As can be seen, there is a significant area of the HOT lanes 204*a-b* that is outside the viewing area 210 (e.g., a significant area that is unable to read the DMS 100 by design). In one embodiment, the length L1 of the HOT lanes 204*a-b* completely unable to read the DMS message is about 146 feet. A length L2 of the HOT lanes 204*a-b* that is at least partially blocked is about 420 feet. A length L3 of lane 202*a* in which it may be difficult to read the DMS message is about 110 feet. Preferably, the DMS 100 is sized so that a visibility length L4 of the message extends at least 1000 feet.

Figure 6:
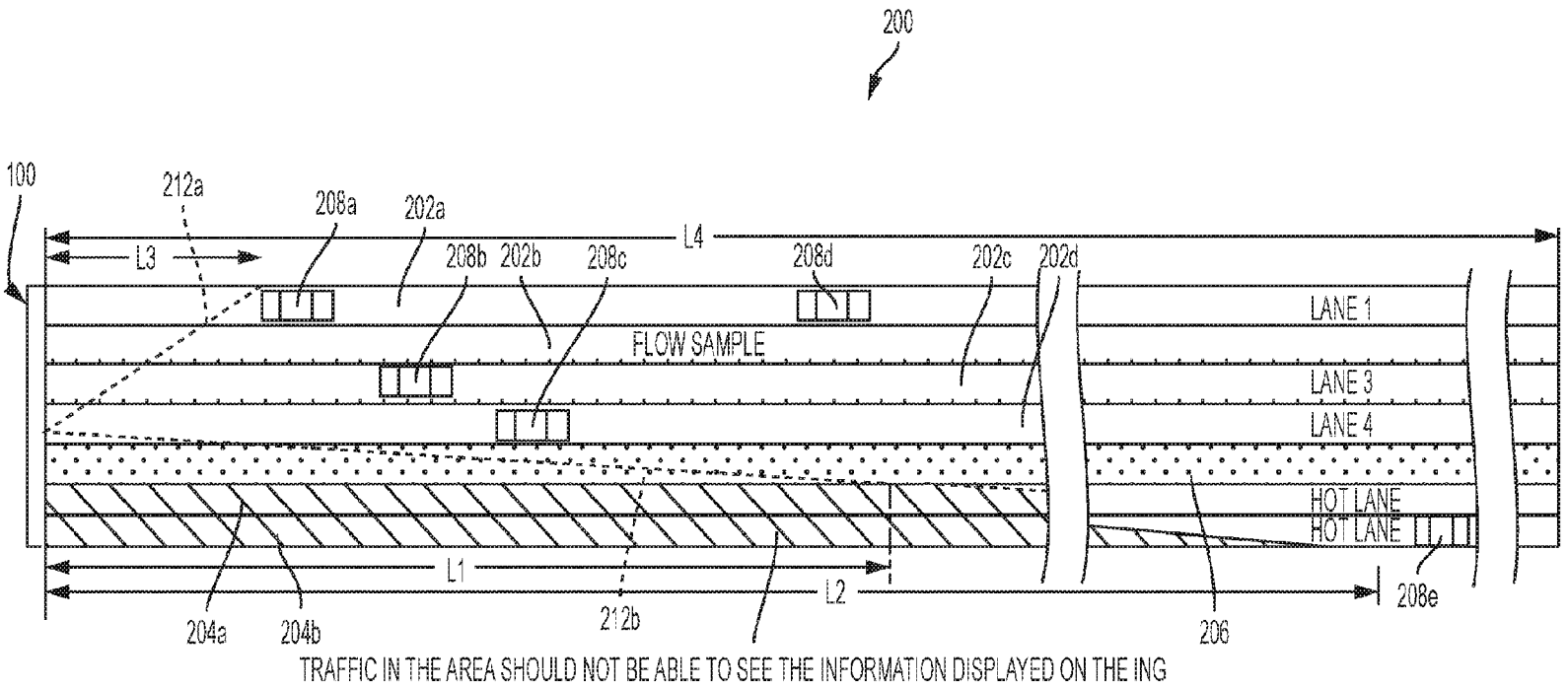
FIG. 6 is an overhead view of a highway with another DMS deployment thereon in accordance with the subject technology.

Referring now to FIG. 6, an overhead view of the highway 200 with another DMS deployment thereon is illustrated. As will be appreciated by those of ordinary skill in the pertinent art, the highway 200 is drawn with like reference numerals as shown above in FIG. 5. In this embodiment, the DMS 100 has been adjusted to include an angle $\alpha$ between the front housing 102 and back frame 104. As such, the lengths L1, L2 and L3 are modified. The length L1 is about 357 feet, the length L2 is about 816 feet and the length L3 is about 88 feet.

Figure 7:
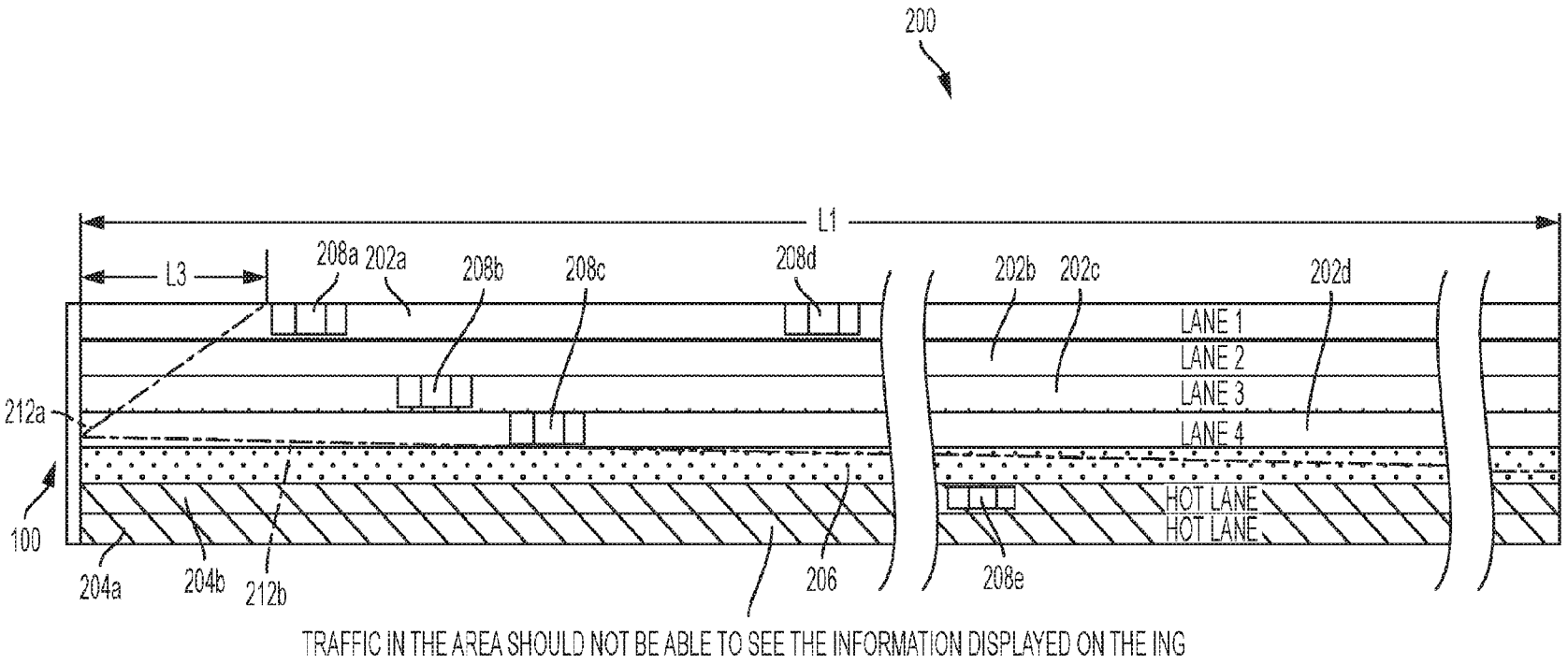
FIG. 7 is an overhead view of a highway with still another DMS deployment thereon in accordance with the subject technology.

Referring now to FIG. 7, an overhead view of the highway 200 with still another DMS deployment thereon is shown. Again, the DMS 100 has been adjusted to include a different angle $\alpha$ between the front housing 102 and back frame 104. As such, the length L1 is about 1000 feet, the length L2 is over 1000 feet and the length L3 is about 82 feet.

Figure 8:
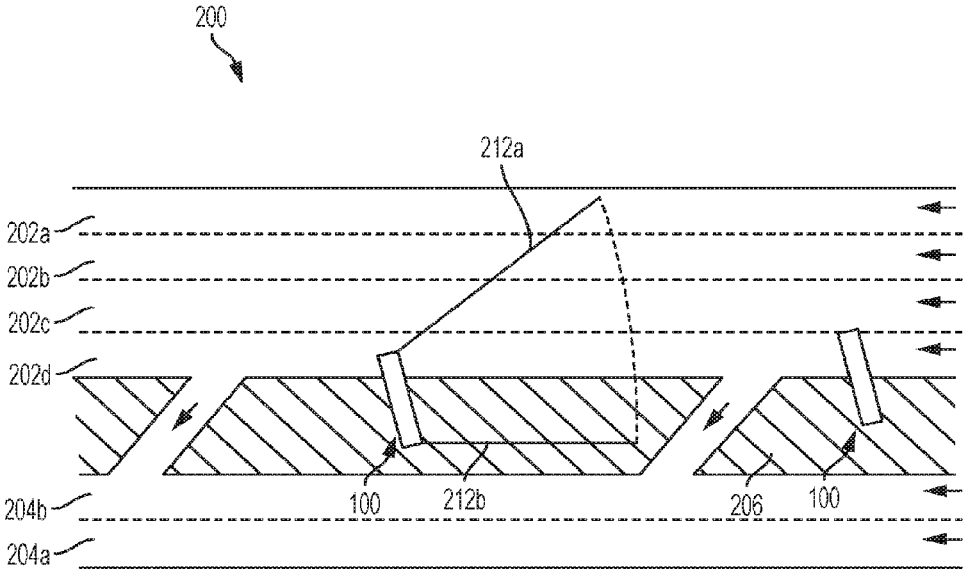
FIG. 8 is an overhead view of a highway with yet another DMS deployment thereon in accordance with the subject technology.

Referring now to FIG. 8, an overhead view of the highway 200 with another DMS deployment thereon is shown. The highway 200 includes a plurality of DMS 100. In this embodiment, each DMS 100 has been adjusted to include an angle $\alpha$ of 10 degrees between the front housing 102 and back frame 104. The DMS 100 are particularly placed to straddle the dividing area 206 and normal lane 202*d* so that the HOT lanes 204*a-b* cannot see the DMS message at all.

Figure 9:
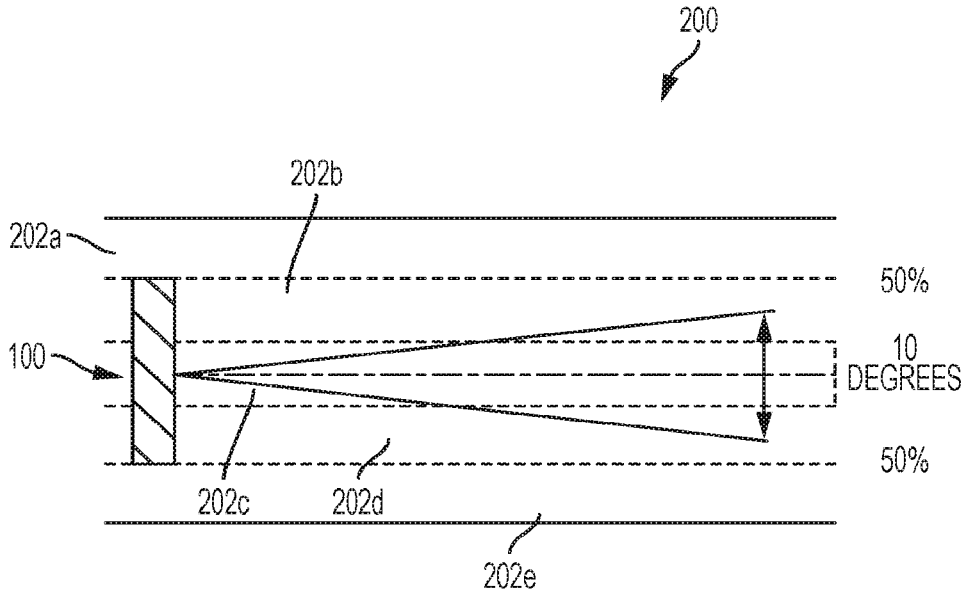
FIG. 9 is an overhead view of a highway with another exemplary DMS deployment thereon in accordance with the subject technology.

Referring now to FIG. 9, an overhead view of the highway 200 with yet another DMS deployment thereon is shown. In this embodiment, the DMS 100 has longer louvers 132 on each side of the LEDs 122 so that the cone of vision 236 is significantly limited to about 10 degrees. As such, only the central lane 202*c* or adjacent lanes 202*b*, 202*d* can view the DMS message.

As can be seen from review of the subject disclosure, the louver configuration and/or angle $\alpha$ can be adjusted to produce a desired result suitable for a particular application. In another embodiment, both sides of the front housing can be inserted with a bracket. The DMS can also be equipped with a kit having a plurality of different brackets for on-site adjustment. In another embodiment, rather than including a back frame and bracket, the front housing is simply mounted on the support at an angle with respect to the oncoming traffic.

The subject technology is also applicable to many other areas. For example, the sign may be any size for any application. A DMS could be one square foot for use as a crosswalk sign directed at pedestrians. A DMS may provide information at a train station regarding train information, safety information and/or provide information to aide in flow of pedestrian traffic. Stores may use a plurality of DMS to provide information outside the store such as "open" or "closed" as well as information in the store such as various "specials" information inside the store. The DMS can be any color and, thus, color can be selected to be suited for the application. The subject technology is also particularly suited to retrofit on existing sign structures. Providing a bracket or other like mechanism to set the angle is particularly useful in retrofit applications.

It will be appreciated by those of ordinary skill in the pertinent art that the functions of several elements may, in alternative embodiments, be carried out by fewer elements, or a single element. Similarly, in some embodiments, any functional element may perform fewer, or different, operations than those described with respect to the illustrated embodiment. Also, functional elements (e.g., assemblies, brackets, modules, interfaces, housings and the like) shown as distinct for purposes of illustration may be incorporated within other functional elements in a particular implementation.

All patents, patent applications and other references disclosed herein are hereby expressly incorporated in their entireties by reference. While the subject technology has been described with respect to preferred embodiments, those skilled in the art will readily appreciate that various changes and/or modifications can be made to the subject technology without departing from the spirit or scope of the invention as defined by the appended claims.

What is claimed is:

1. A dynamic message sign comprising:

a front housing defining a viewing window and an interior;

a LED assembly in the interior for displaying a message;

a back frame for supporting the front housing; and a motor connected between the back frame and front housing for selectively setting the front assembly at an angle with respect to the back frame.

2. A dynamic message sign as recited in claim 1, further comprising a louver assembly for limiting a cone of vision of the dynamic message sign.

3. A dynamic message sign as recited in claim 2, wherein the louver assembly includes a plurality of louver racks, each louver rack having a plurality of louvers extending adjacent to a column of LED pixels.

4. A dynamic message sign as recited in claim 1, wherein the LED assembly includes a plurality of LED pixels arranged in rows and columns.

5. A dynamic message sign comprising:

a front housing defining a viewing window and an interior;

a LED assembly in the interior for displaying a message within a cone of vision;

a louver assembly for limiting the cone of vision;

a back frame for supporting the front housing; and a motor connected between the back frame and front housing for selectively setting the front assembly at an angle with respect to the back frame.

* * * * *